US006327429B1

(12) United States Patent
Chan

(10) Patent No.: US 6,327,429 B1
(45) Date of Patent: Dec. 4, 2001

(54) COFFEE MAKER HEATER

(75) Inventor: Yee-Koo Chan, Hong Kong (CN)

(73) Assignee: Electrical & Electronics Limited, Tai Po (CN)

( * ) Notice: Subject to any disclaimer, the term of this patent is extended or adjusted under 35 U.S.C. 154(b) by 0 days.

(21) Appl. No.: 09/592,872

(22) Filed: Jun. 13, 2000

(51) Int. Cl.[7] ..... F24H 1/10
(52) U.S. Cl. ..... 392/483; 392/467
(58) Field of Search ..... 392/465, 485, 392/467, 458, 99

(56) References Cited

U.S. PATENT DOCUMENTS 3,878,360 * 4/1975 Augustine et al. ..... 392/465
3,953,923 * 5/1976 Rygmyr ..... 29/611
5,367,607 * 11/1994 Hufnagl et al. ..... 392/465

* cited by examiner

*Primary Examiner*—Teresa Walberg
*Assistant Examiner*—Thor Campbell
(74) *Attorney, Agent, or Firm*—Alix, Yale & Ristas, LLP

(57) ABSTRACT

A coffee maker heater shortens brew times by employing steel components which are brazed together. A copper brazing material efficiently conducts heat from the coffee maker heater element to the base plate and water tube. Brazing increases the thermally conductive surface area of the junctions between components of the coffee maker. A stainless steel water tube minimizes contamination of the heated water. Steel components tolerate increased levels of heat, permitting use of high power heater elements. The combination of high power heater elements with improved thermal performance shortens brew times by as much as one third.

5 Claims, 6 Drawing Sheets

COFFEE MAKER HEATER

BACKGROUND OF THE INVENTION

1. Field of the Invention

This invention generally relates to heaters used in automatic coffee makers. More specifically, this invention relates generally to the configuration of the base plate, heater element and water tube found in automatic coffee makers.

2. Description of the Related Art

Drip coffee makers typically include a base plate, a water tube and an electric heater element. The purpose of the heater is two-fold. The heater is used to boil water which flows into the water tube. The heated water expands and flows to the top of the coffee maker where it descends through the coffee grounds and into the coffee pot. The heater also warms the base plate which keeps the brewed coffee hot after it is brewed.

It is known in the art to die cast coffee maker base plates out of aluminum. A known configuration includes a cast channel projecting from the bottom surface of the base plate. An appropriately shaped water tube is press fit into the channel to a position adjacent to the bottom surface of the base plate. A heater element is then press fit into the channel below the water tube so that the water tube is between the heater and the base plate. In this configuration, the heater has direct contact with the water tube at a point along the length of their respective tubular circumferences. The heater has direct contact with the base plate along either side of its tubular circumference where the heater is adjacent to the base plate channel. A heater in this configuration heats water in the water tube by direct contact and indirectly via heating of the base plate.

Another existing design uses an aluminum extrusion where the water tube and heater channel are manufactured as a single part. The heater channel and water tube are extruded so that they share one longitudinal surface. The water tube is placed between the heater and the base plate. In this configuration, the heater heats the water tube directly and the base plate indirectly via the water tube.

These prior art designs share several problems. First, the aluminum castings or extrusions are relatively expensive to manufacture. Second, the aluminum materials have properties (such as a relatively low melting point) which limit the power of the heating element which can be used. Third, these designs produce a narrow contact interface between the heater and water tube. The small contact surface between the water tube and the heater does not permit the efficient transfer of heat from the heater to the water tube. Finally, many consumers claim that the aluminum materials adversely affect the taste of the coffee. Aluminum is reactive with acids found in coffee and may actually be dissolved into the heated water and ultimately the brewed coffee.

SUMMARY OF THE INVENTION

A coffee maker heater in accordance with the present invention comprises a heater, water tube and base plate made of steel materials. In a preferred embodiment, at least the water tube and heater are joined directly to each other by brazing. In an alternative embodiment, the water tube and heater element are separately brazed to a thickened base plate. Another alternative embodiment includes punching tabs from the base plate which extend on either side and between the heater and water tube. The tabs further increase the surface area contact between the heater, water tube and base plate. A still further alternative embodiment may utilize a pre-formed stainless steel channel having a location for the heater element and a portion to house the water tube. The heater and water tube are brazed within the stainless steel channel. This configuration allows for heat transfer via the copper brazing and the stainless channel. The brazing material is preferably copper-based.

The steel materials are preferably stainless steel alloys used in the food service industry. These materials may be standard plate and tubular items, manufactured and sold for food service use. Stainless steel is far less reactive with hot liquids than aluminum and has much improved heat tolerance. According to one aspect of the invention, standard stainless steel products can be formed to the desired configuration and brazed together to form the coffee maker heater assembly. Use of standardized materials eliminates the expensive casting and extruding steps required by prior art designs.

A copper brazed junction between the water tube and heater (or alternatively the heater and base plate) greatly improves both the surface area and the thermal conductivity of the junction between heat producing and heat receiving parts of the coffee maker.

The increased heat tolerance of steel materials permits use of high power heater elements. A high power heater element combined with the improved heat transfer characteristics of the junction between components greatly shortens the brewing time over the prior art designs.

An object of the present invention is to produce a new and improved coffee maker heater which may be cost effectively manufactured from readily available steel materials.

Another object of the present invention is to produce a new and improved coffee maker heater which significantly shortens the brewing time of a coffee maker.

A further object of the present invention is to produce a new and improved coffee maker heater which permits the use of a high power heater element.

A still further object of the present invention is to produce a new and improved coffee maker heater which does not introduce aluminum in materials into the brewing water.

These and other objects, features and advantages of the invention will become readily apparent to those skilled in the art upon reading the description of the preferred embodiments, in conjunction with the accompanying drawings.

DESCRIPTION OF THE PREFERRED EMBODIMENTS

Referring now to the Figures, in which like numbers represent like parts, embodiments of a coffee maker heater in accordance with the present invention will be represented by the numerals 10*a*–10*d*.

Figure 1:
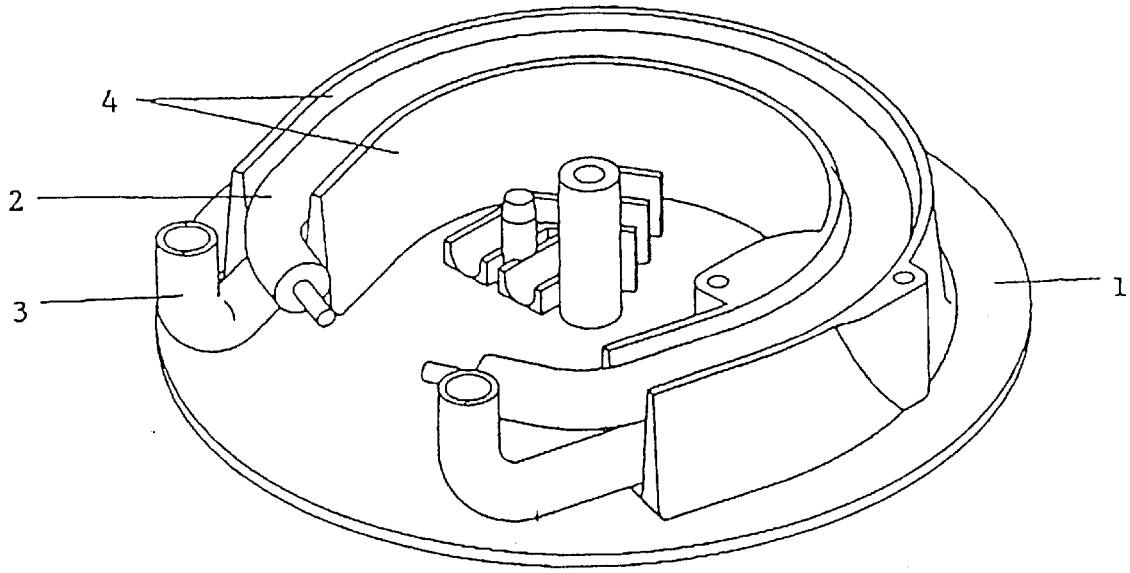
PRIOR ART Figure 1
FIG. 1 is a perspective view of the underside of a prior art coffee maker base plate.
Figure 2:
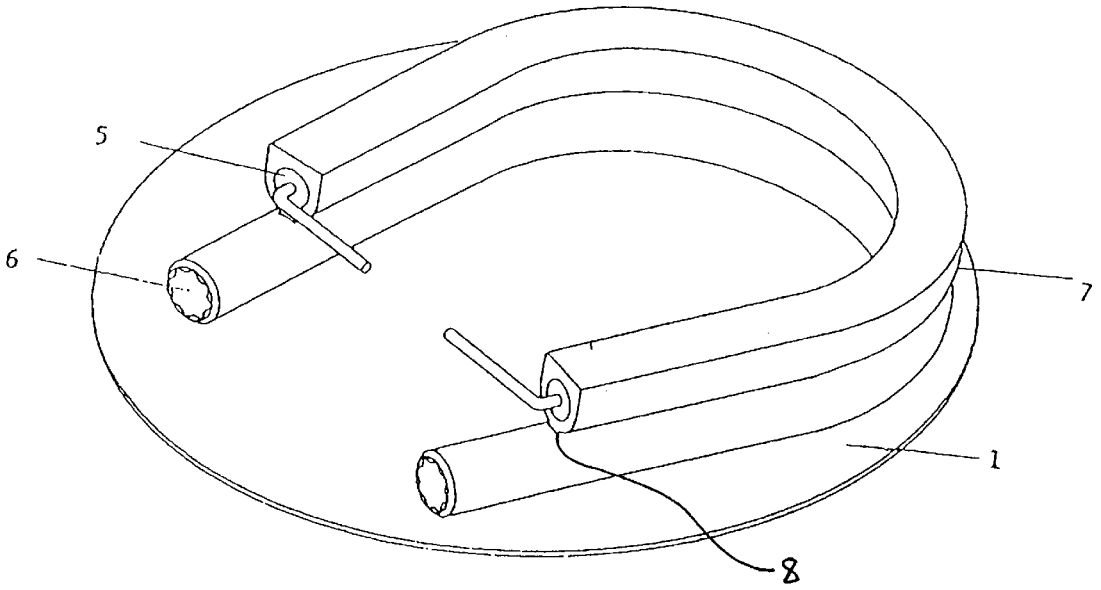
PRIOR ART Figure 2
FIG. 2 is a perspective view of the underside of an alternative prior art coffee maker base plate.

FIGS. 1 and 2 illustrate coffee maker base plates incorporating prior art coffee maker heater configurations. FIG. 1 illustrates a die cast aluminum base plate 1 having a U-shaped channel 4 projecting from the bottom surface of the base plate 1. A similarly U-shaped water tube 3 and heater 2 are pressed into the channel 4 where they are retained by friction fit. The channel 4 may be squeezed to further retain the water tube 3 and heater 2. Heat is conducted from the heater 2 to the base plate 1 and the water tube 3 only at those points where the heater 2 contacts the walls of the channel 4 and the water tube 3.

FIG. 2 illustrates a somewhat improved prior art coffee maker heater configuration. In this prior art configuration, the water tube 6 and the heater element housing 7 are formed as an attached aluminum extrusion. A heater element 5 is inserted into the heater element housing 7. Improved heat transfer (relative to the arrangement of FIG. 1) takes place along the junction 8 between the heater housing 7 and the water tube 6.

Figure 3:
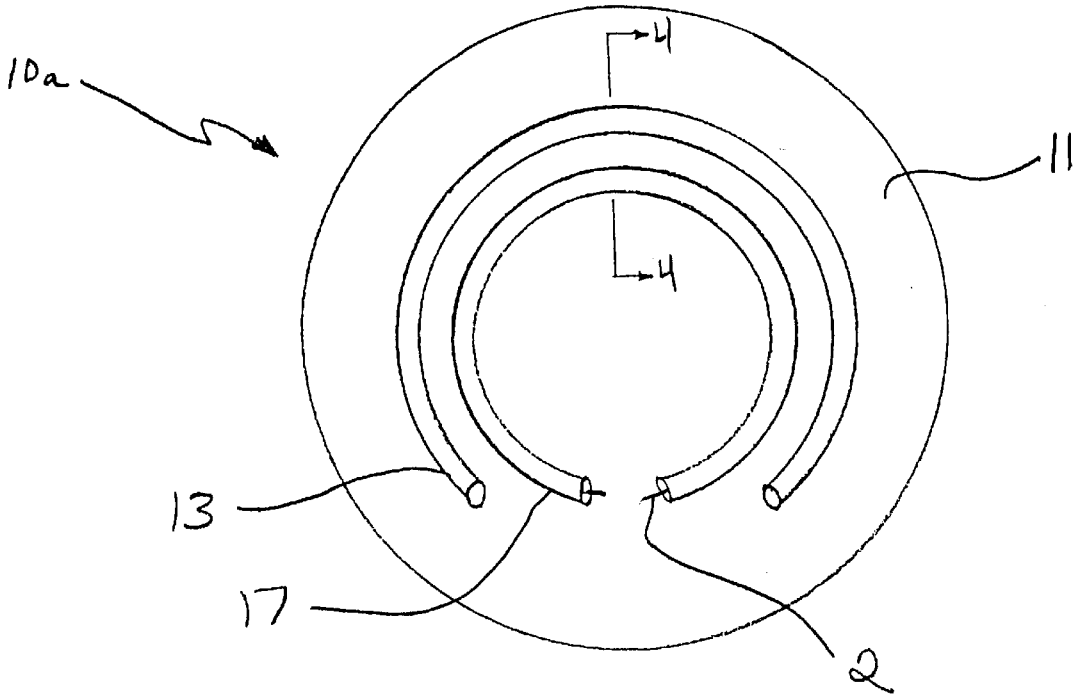
FIG. 3 is a bottom view of a coffee maker base plate incorporating a coffee maker heater in accordance with the present invention.

FIG. 3 illustrates an embodiment of coffee maker heater 10*a* in accordance with the present invention. A semi-circular water tube 13 and heater element housing 17 are brazed to a thickened base plate 11.

Figure 4:
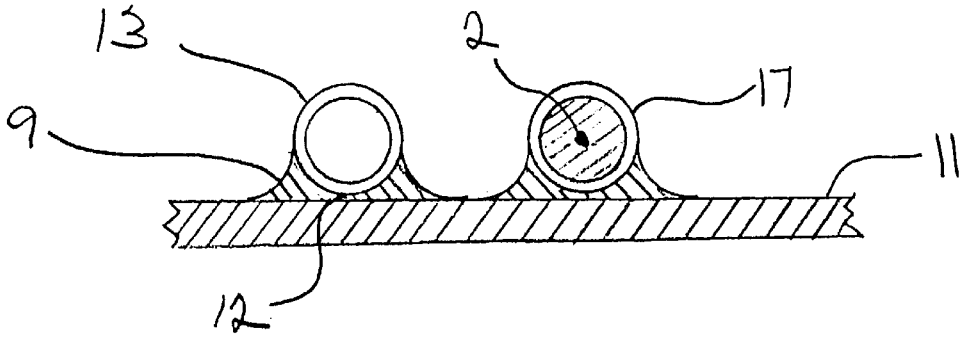
FIG. 4 is a partial sectional view of the coffee maker base plate of FIG. 3, taken along line 4—4 thereof.

Brazing the water tube 13 and the heater element housing 17 to the base plate 11 increases the surface area capable of transferring heat from the heater element 2 to the base plate 11 and the water tube 1 3. FIG. 4 illustrates that brazing material 9 fills the area adjacent to the bottom portion of the water tube 13 and heater element housing 17. The brazing material 9 expands what would be a point of contact 12 into a broad and highly thermally conductive interface.

A preferred material for the base plate 11 is steel. In the embodiment illustrated in FIGS. 3 and 4, the base plate 11 will be somewhat thicker than that necessary for prior art designs because the configuration relies upon the base plate 11 to conduct heat from the heater element 2 to the water tube 13. A preferred material for the water tube 13 is stainless steel. A stainless steel water tube avoids the aluminum contamination problem and is compatible with the brazing process. Preferred brazing materials have a high copper content. Copper is an excellent thermal conductor which greatly improves heat transfer between the components of the coffee maker heater 10*a*. Stainless or ordinary steel tubing may be used for the heater element housing 17.

The steel components have a higher heat tolerance than the prior art aluminum components. Aluminum components, particularly the heater element housing, have limited the power of heater elements which could be used to approximately 900 watts. Higher heat tolerance allows use of a heater element 2 having a power rating of approximately 1,200 watts. A higher power heater element will achieve a higher temperature more quickly, thereby shortening the time required to boil water in the water tube 13.

The configuration of coffee maker heater 10*a* improves the speed with which water in the water tube 13 reaches boiling temperature in at least two ways. First, all steel construction permits use of heater elements having a high power rating. The high temperatures achieved by the high power heater element are efficiently transferred to the other components of the coffee maker heater 10*a* by the greatly improved surface area of the brazed connection between the water tube 13, heater element housing 17 and base plate 11.

Figure 5:
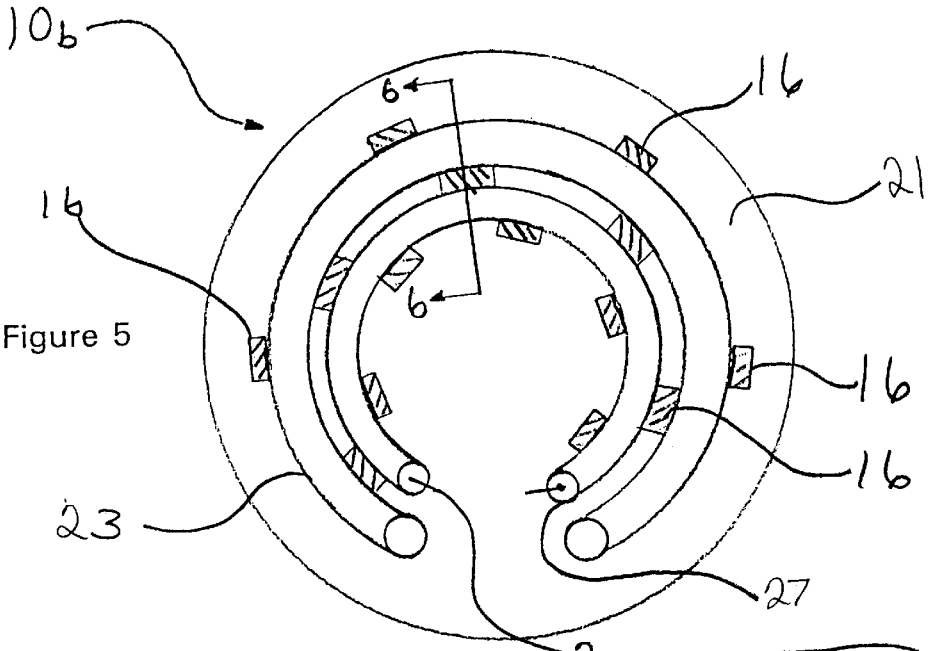
FIG. 5 is a bottom view of a coffee maker base plate incorporating an alternative embodiment of a coffee maker heater in accordance with the present invention.
Figure 6:
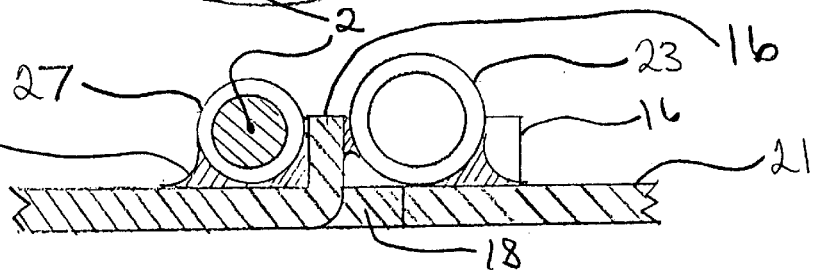
FIG. 6 is a partial sectional view of the coffee maker base plate of FIG. 5, taken along line 6—6 thereof.
Figure 7:
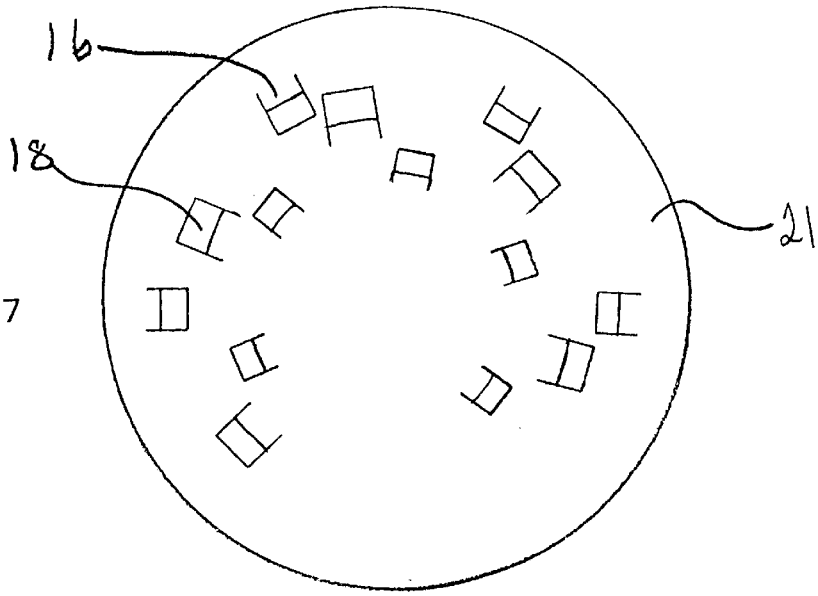
FIG. 7 is a top view of the coffee maker base plate of FIG. 5.

FIGS. 5–7 illustrate a second alternative embodiment of a coffee maker heater 10*b* in accordance with the present invention. The semi-circular water tube 23 and heater element housing 27 are placed on the base plate 21 as in embodiment 10*a*. Embodiment 10*b* includes separation tabs 16 punched from the base plate 21 material. Perforations 18 in the base plate 21 are formed by the process of punching and bending the tabs 16 into a position essentially perpendicular to the bottom surface of the base plate 21. The pattern of tabs 16 allows the water tube 23 and heater element housing 27 to be pressed into position and held during the brazing process. Thus, the tabs 16 improve the accuracy of the placement of components on the base plate 21. The tabs also provide thermally conductive attachment points for the brazing material 9, thereby improving thermal transfer among the heater element housing 27, water tube 23 and base plate 21.

Figure 8:
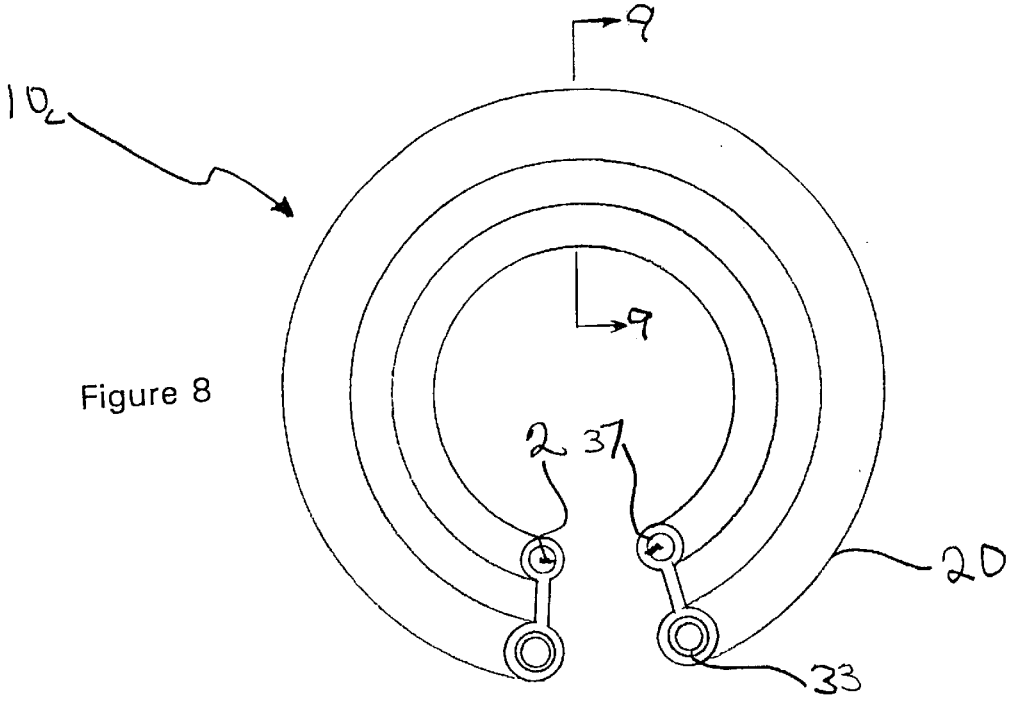
FIG. 8 is a bottom view of a further alternative embodiment of the coffee maker heater in accordance with the present invention.
Figure 9:
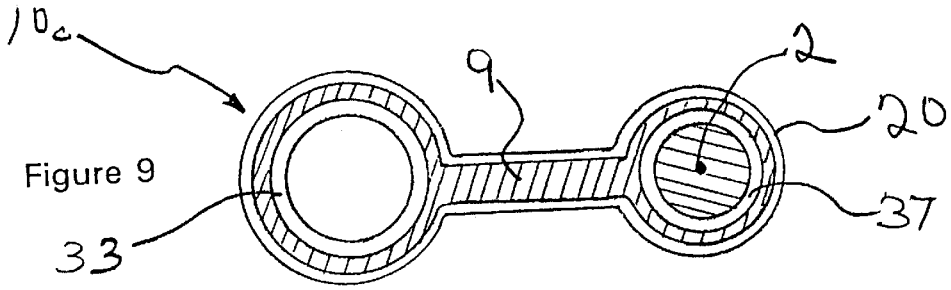
FIG. 9 is a sectional view of the coffee maker heater of FIG. 8, taken along line 9—9 thereof.
Figure 10:
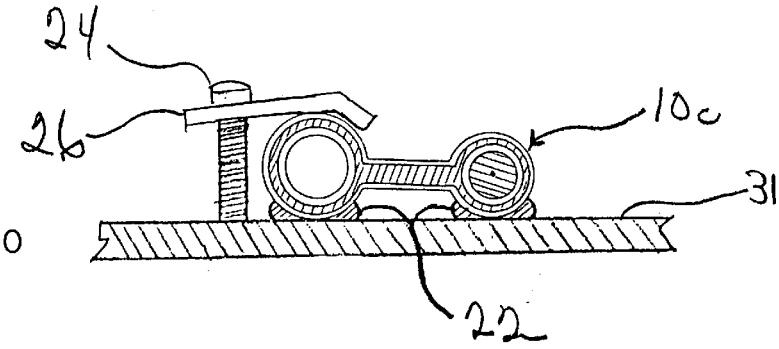
FIG. 10 is a sectional view of the coffee maker heater of FIG. 8 installed on a coffee maker base plate (partially illustrated)

FIGS. 8–10 illustrate a third alternative embodiment of a coffee maker heater 10*c* in accordance with the present invention. Heater 10*c* employs a pre-formed, semi-circular heater container 20. The linked tubes of the container 20 provide locations for installation of the water tube 33 and heater element housing 37. Once installed, the water tube 33 and heater element housing 37 are brazed within the container 20. In coffee maker heater 10*c*, brazing material 9 surrounds both the heater element housing 37 and the water tube 33. The copper-based brazing material provides an excellent thermal pathway from the heater element housing 37 to the water tube 33. FIG. 10 illustrates one possible arrangement for fixing the container 20 with its internal components to the underside of a base plate 31. A screw 24 and clamp 26 may be used to hold the container against the base plate 31. Heat conductive grease 22 (or its equivalent) may be used to improve thermal conductivity from the container 20 to the base plate 31.

Figure 11:
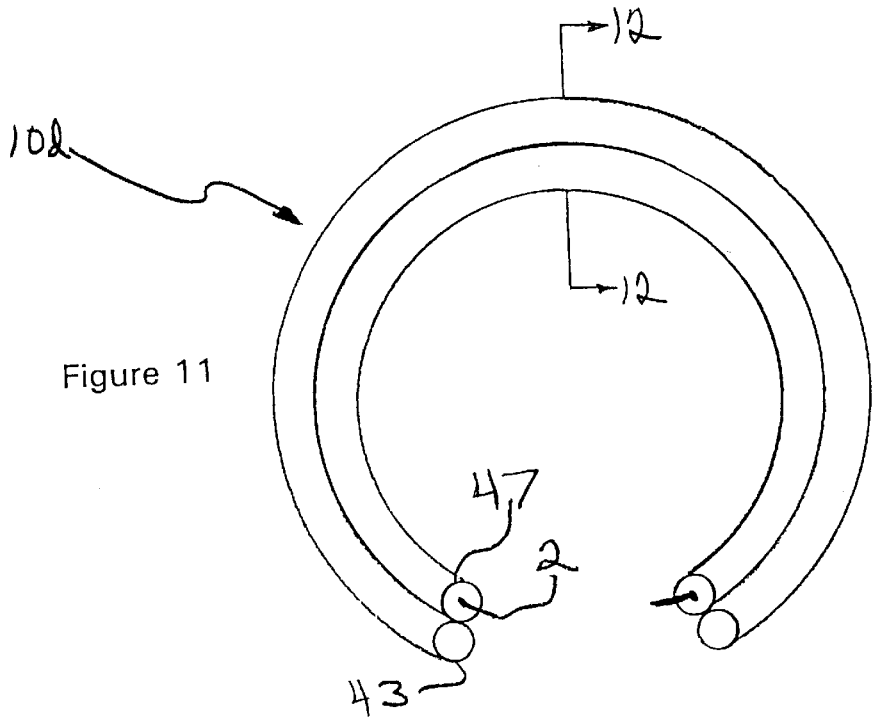
FIG. 11 is a bottom view of a still further alternative embodiment of a coffee maker heater in accordance with the present invention.
Figure 12:
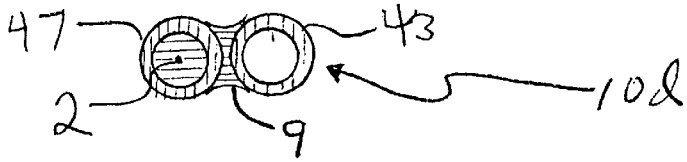
FIG. 12 is a sectional view of the coffee maker heater of FIG. 11, taken along line 11—11 thereof.
Figure 13:
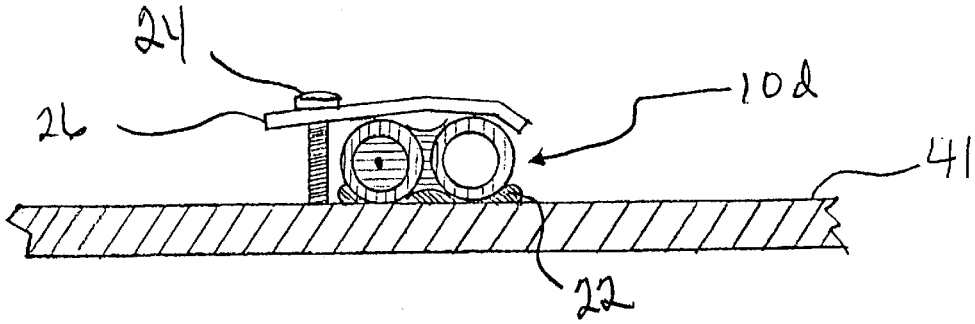
FIG. 13 is a sectional view of the coffee maker heater of FIG. 11 installed on a coffee maker base plate (partially illustrated).

FIGS. 11–13 illustrate a fourth alternative embodiment of a coffee maker heater 10*d* in accordance with the present invention. In this configuration, the heater element housing 47 and water tube 43 are brazed only to each other. Efficient transfer of heat takes place along the brazed junction between the two tubes 47, 43. Construction of a coffee maker using this heater configuration 10*d* is simplified because the coffee maker heater 10*d* may be fabricated separately from the base plate 41 and installed using clamps 26, screws 24 and heat transmissive grease 22 (or the equivalent) (see FIG. 13).

Any of the alternative embodiments 10*a*–10*d* may be efficiently produced using a furnace brazing technique. In this process, the components are placed in their desired positions relative to each other. Brazing material and flux are applied to the surfaces and in the areas to be joined. The parts are then heated in a furnace to the melting point of the brazing material. When the components are removed from the furnace, they are connected by the solidified brazing material.

While preferred embodiments of the foregoing invention have been set forth for the purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A coffee maker heater comprising:

a steel base plate including tabs comprising portions of said base plate that are displaced to project generally orthogonal to said base plate, said tabs arranged in a pattern to define adjacent arcuate paths between said tabs, a stainless steel water tube, a steel heater element housing, and a heater element, wherein said heater element is disposed in said heater element housing and said water tube and heater element housing are arranged in said adjacent arcuate paths, at least some of said tabs disposed between said water tube and said heater element housing and said water tube and heater element are retained to said base plate by said tabs, said water tube and heater element housing being brazed to said base plate, said at least some of said tabs providing a thermal connection between said water tube and heater element housing.

2. A coffee maker heater comprising:

a stainless steel water tube, a steel heater element housing, a steel base plate, and a heater element, wherein said heater element is disposed in said heater element housing and said water tube and heater element housing are brazed to said base plate in spaced relationship so that heat produced by said heater is transmitted to said water tube primarily through said base plate.

3. The coffee maker heater of claim 2, wherein a copper-base brazing compound is used.

4. The coffee maker heater of claim 2, wherein said heater element has a power consumption of at least 1000 watts.

5. The coffee maker heater of claim 1, wherein said brazing uses a copper based brazing material.

* * * * *

UNITED STATES PATENT AND TRADEMARK OFFICE

CERTIFICATE OF CORRECTION

PATENT NO. : 6,327,429 B1
DATED : December 4, 2001
INVENTOR(S) : Chan

It is certified that error appears in the above-identified patent and that said Letters Patent is hereby corrected as shown below:

Column 6,
Line 26, insert the new claim 6 as follows:

-- 6. The coffee maker heater of claim 1, wherein said element has a power consumption of at least 1000 watts. --

Signed and Sealed this

Fifteenth Day of April, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,327,429 B1
DATED : December 4, 2001
INVENTOR(S) : Chen

It is certified that error appears in the above-identified patent and that said Letters Patent is hereby corrected as shown below:

Title page,
Item [12], should read -- Chen --
Item [75], should read -- Yee-Koo Chen, Hong Kong (CN) --

Column 6,
Line 26, insert the new claim 6 as follows:

-- 6. The coffee maker heater of claim 1, wherein said heater element has a power consumption of at least 1000 watts. --

This certificate supersedes Certificate of Correction issued April 15, 2003.

Signed and Sealed this

Tenth Day of June, 2003

JAMES E. ROGAN
*Director of the United States Patent and Trademark Office*